US006540292B2

(12) United States Patent
Darling et al.

(10) Patent No.: US 6,540,292 B2
(45) Date of Patent: Apr. 1, 2003

(54) ADJUSTABLE ROCKER SEAT

(75) Inventors: Sandra Darling, Niceville, FL (US); Bryan M. Brown, Buffalo, NY (US); Julia Favorito, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 09/322,176

(22) Filed: May 28, 1999

(65) Prior Publication Data

US 2002/0050728 A1 May 2, 2002

(51) Int. Cl.[7] ..... A47C 13/00

(52) U.S. Cl. ..... 297/130; 297/271.6; 297/258.1; 297/32

(58) Field of Search ..... 297/258.1, 271.1, 297/271.5, 271.6, 272.1, 130, 118, 32, 33

(56) References Cited

U.S. PATENT DOCUMENTS

| | | | | | |
|---|---|---|---|---|---|
| 281,617 | A | * | 7/1883 | Cove | 297/33 |
| 2,017,599 | A | * | 10/1935 | Lehner | 297/32 X |
| 2,414,298 | A | * | 1/1947 | Haich | 297/32 X |
| 2,543,543 | A | * | 2/1951 | Gomes et al. | 297/32 |
| 2,797,738 | A | | 7/1957 | Patterson | |
| 3,047,333 | A | * | 7/1962 | Stanimir | 297/32 X |
| 3,180,679 | A | * | 4/1965 | Berlin | 297/33 |
| 3,269,771 | A | * | 8/1966 | Erdos | 297/118 |
| 3,463,504 | A | | 8/1969 | Petry et al. | |
| 4,019,751 | A | | 4/1977 | Nako | |
| D246,682 | S | | 12/1977 | Nakao | |
| 4,113,306 | A | | 9/1978 | von Wimmersperg | |
| 4,371,206 | A | | 2/1983 | Johnson, Jr. | |
| 4,500,133 | A | | 2/1985 | Nakao et al. | |
| 4,688,850 | A | | 8/1987 | Brownlie et al. | |

(List continued on next page.)

OTHER PUBLICATIONS

Hardcopy of webpage for MTS Products J. Mason Activity Seats and Bouncers, 2001.

Kolcraft Baby's 1st Jeep Rocker Instructions, 2001.

Kolcraft Rock 'n Play infant rockers/carriers product description and attached JPTS Retail Sales Report, 1995.

Owner's Guide, Safety 1st 3–in–1 Bounce & Rocker, 2000.

Photographs of Safety 1st 3–in–1 Bounce & Rocker, J. Mason® Expressions Bouncer and Kolcraft Baby's 1st Jeep® Rocker; Figs. 1–12; Dec., 2000, May 2001 and Jun. 2001.

*Primary Examiner*—Anthony D. Barfield
(74) *Attorney, Agent, or Firm*—Morgan, Lewis & Bockius LLP

(57) ABSTRACT

An adjustable children's rocking chair is shown that can be readily converted without the use of tools between a configuration where it is used to support an infant in a more reclined position, and a configuration where it is suitable for use as a rocking chair by a toddler. The rocking chair includes a seat portion, a support portion connected to the seat portion, and the support portion being pivotably connected to a rocker base and being adjustable in length. The support portion includes a front frame assembly, such as a pair of front legs, and a rear frame assembly, such as a pair of rear legs, with each of the front legs being pivotably connected to a respective rear leg through a detachable joint. The seat portion includes a back support portion that is formed by a U-shaped seat back tube slipped inside a pocket in soft goods. Both ends of the U-shaped seat back tube are connected to the detachable joints pivotably connecting the rear legs to the front legs. The seat portion also includes a bottom formed by a rigid board permanently attached to a transverse member extending between the front legs and slipped into a second pocket in the soft goods. As the rear legs are telescopically changed in length, the legs pivot relative to each other and to the rocker base, with a resulting change in inclination of the seat back tube and back support portion.

13 Claims, 7 Drawing Sheets

U.S. PATENT DOCUMENTS 4,718,715 A * 1/1988 Ho ..... 297/130
4,807,926 A * 2/1989 Brunn ..... 297/33
4,986,599 A 1/1991 Wise
5,011,221 A 4/1991 Wise
5,178,438 A 1/1993 Beger
5,507,550 A 4/1996 Maloney
5,868,459 A * 2/1999 Welsh, Jr. ..... 297/258.1 X
5,947,552 A * 9/1999 Wilkins et al. ..... 297/16.1

* cited by examiner

ADJUSTABLE ROCKER SEAT

BACKGROUND OF THE INVENTION

1. Field of the Invention

The present invention relates to an adjustable rocking seat for children. More particularly, the present invention is directed to a rocking seat that adjusts from a more reclined to a more inclined position, which is accomplished in the preferred embodiments by adjusting the length of rear support legs for the seat.

2. Related Art

A variety of infant chairs are known in the art. Infant chairs include baby carriers that can sit on a floor at an adjustable angle and support a baby reclining on its back. U.S. Pat. No. 3,361,473 to Dudouyt teaches a chair having a seat and a back connected to legs by a clampable pivot, allowing the parts to be moved relative to each other.

U.S. Pat. No. 4,019,751 to Nakao discloses a multipurpose infant's chair that can be used as a baby carriage, rocking play device or bed as desired by moving a few parts of the chair.

U.S. Pat. No. 5,178,438 to Beger discloses an infant rocking device that includes a rocking frame and a stretching frame for stretching a sheet adapted to accommodate an infant. The stretching frame is pivotably mounted on the rocking frame by at least two detachable couplers that each include a clamping sleeve adapted to be clamped on to the free end of the rocking frame to provide for pivotable movement of the stretching frame with respect to the rocking frame.

U.S. Pat. No. 4,986,599 to Wise discloses a baby carrier that includes a one-piece shell type seat having a generally U-shaped support rotatably attached to the sides of the shell by simple pivots. The bottom of the shell forms an integral pair of rockers allowing use of the carrier as a rocking cradle.

Another known folding toddler/rocker sold under the trade name "GYMBOREE" includes a folding frame and soft goods suspended from the frame.

None of the conventional infant rocking chairs provide for adjustability from one configuration suitable for small infants to another configuration suitable for larger toddlers. As a result, a problem with conventional rocking seats for infants is that during the rapid growing stage from infant to toddler, infant rocking chairs have a very short useable life span before the infant has outgrown the infant rocking chair. Conventional infant rocking chairs also suffer from the disadvantage that they do not allow for simple and rapid disassembly or folding for storage without the use of tools.

SUMMARY OF THE INVENTION

The shortcomings of conventional rocker chairs are overcome by the rocker chair of the invention, which can be readily converted between a configuration suitable for use by a small infant and a configuration more suitable for use by a larger toddler.

The multi-use chair that can be readily converted without the use of tools between a configuration in which it is used to support an infant, a configuration in which the seat is at a stationary recline suitable for various uses such as feeding an infant or supporting an infant while the infant sleeps, and a more upright configuration for use as a rocking chair by larger toddlers.

The chair can be readily folded into a small volume for storage without the use of tools.

A preferred embodiment of the rocking chair includes a seat portion supported on a support structure that is pivotably connected to a rocker base and is adjustable in height.

More particularly, in the preferred embodiments the seating portion can be supported relative to a rocking base by multiple legs. The legs can be pivotably attached to the base with at least two of the legs being adjustable in length. Preferably, the adjustable legs are pivotably attached to a rear portion of the rocking base and positioned underneath a back support portion of the seating portion. A change in the length of the adjustable legs results in a change in the inclination of the back support portion relative to the rocking base, thus allowing the seating portion to be readily adjusted between a more reclined position suitable for supporting an infant and a more upright position suitable for supporting a larger toddler.

The rocking base of the chair can include two substantially parallel elongated curved members, or rocker rails, each having front and rear ends, and each being pivotably connected at the front and rear ends to respective front and rear leg members. The front and rear leg members associated with each rocker rail are detachably connected to each other and to one end of a curved seat back tube that defines the back support portion of the rocking chair.

A transverse propping member or kickstand can also be pivotably connected between the front ends of the rocker rails that form the rocking base. In its extended position the transverse propping member prevents the chair from rocking, and thus allows the chair to be maintained in a stationary reclined position. The legs pivotably connected to the rear ends of the rocker rails are adjustable in length and are readily detached from the front legs by manual release of engagement members on the joints that connect the rear legs to the front legs.

A vibrating unit can also be provided on a transverse member extending between the rear legs in order to provide a soothing vibration to the chair. The seat portion of the chair is formed by a seat pad (generally referred to as soft goods) that includes a back support portion framed by a seat back tube and a bottom seat portion that can extend over a rigid board permanently attached to a transverse member extending between the front legs. The seat pad is readily removed from the seat back tube and from the rigid board in order to allow for easy cleaning.

BRIEF DESCRIPTION OF THE DRAWINGS

Embodiments of the invention will now be described, by way of example, with reference to the accompanying drawings in which.

DETAILED DESCRIPTION OF THE PREFERRED EMBODIMENTS

An adjustable children's rocker seat according to the preferred embodiments of the invention includes a seat, an arcuate rocker base and an adjustable and collapsible support structure that supports the seat on the arcuate rocker base. The support structure has a front assembly and a rear assembly. In the illustrated embodiments, both assemblies are pivotably coupled to the arcuate rocker base so that they can be rotated down toward the base into a folded or stowed configuration. The change between inclined and reclined positions in the illustrated embodiments is accomplished by changing the axial length of one of the front and rear assemblies and pivoting both of the assemblies relative to the rocker base.

Figure 1:
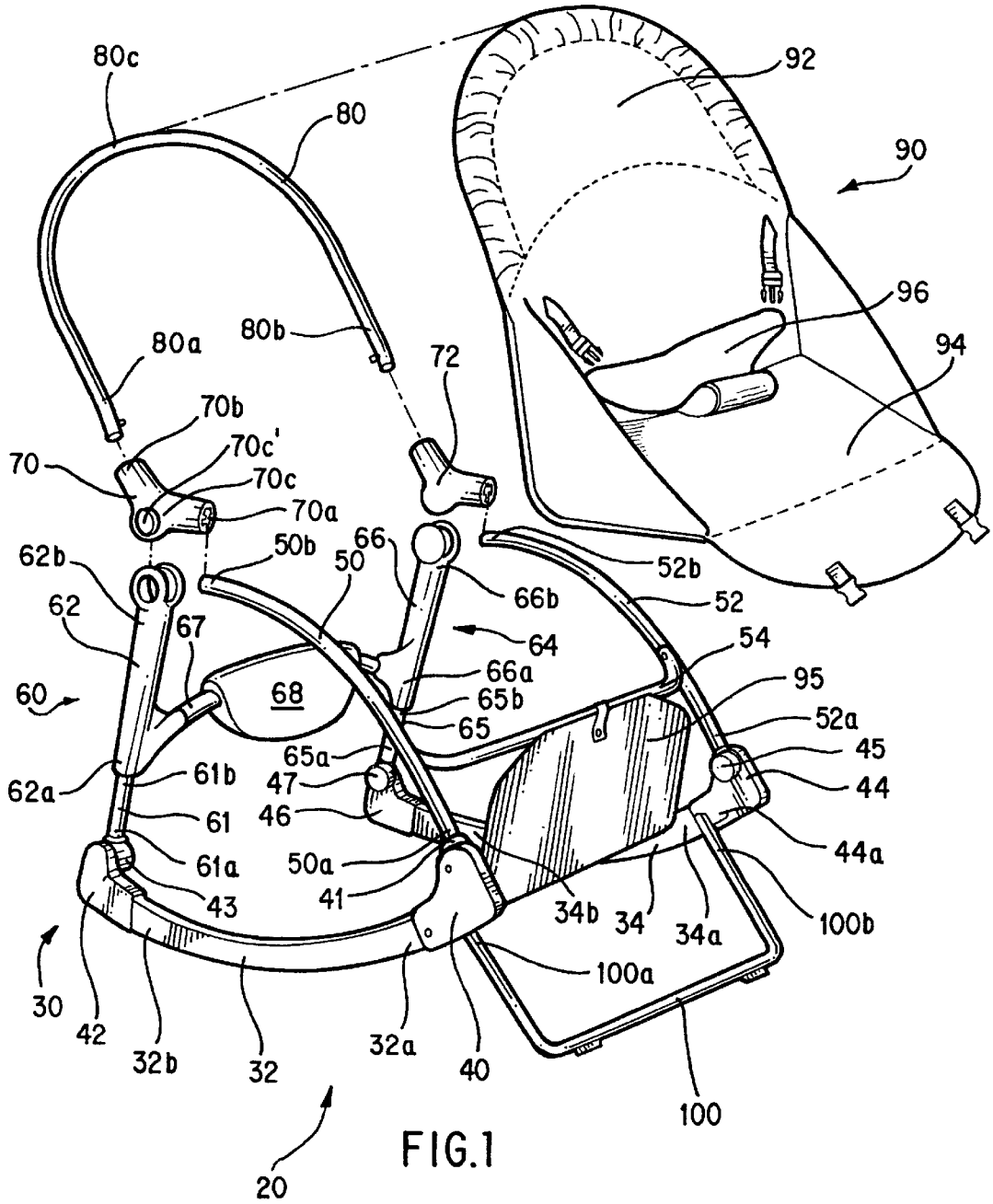
FIG. 1 is an exploded perspective view of a rocker seat according to an embodiment of the invention.
Figure 2:
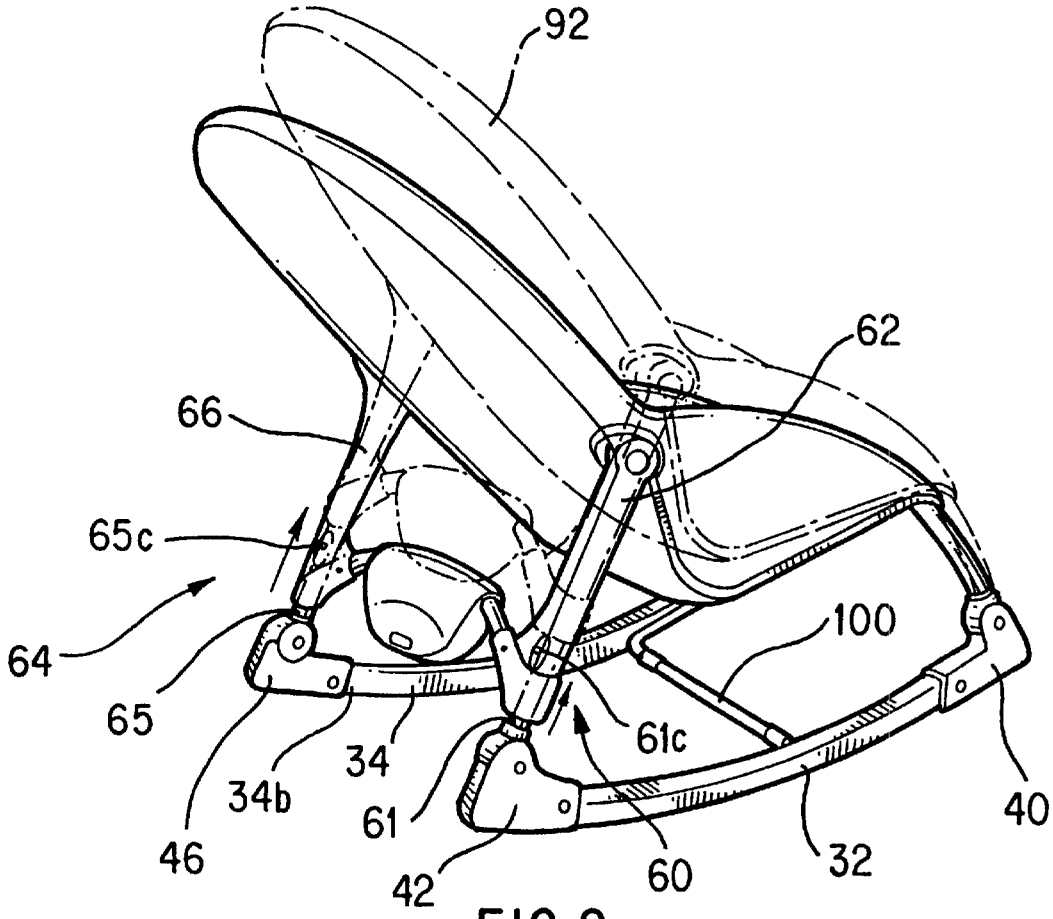
FIG. 2 is a rear perspective view of the rocker seat shown in FIG. 1, illustrating a more inclined position and a more reclined position achieved by adjustments in the length of the rear legs.

An adjustable child's rocker seat embodying the principles of the invention is illustrated in FIGS. 1 and 2. The rocker chair 20 includes an arcuate rocker base 30 and a seating portion 90. The rocker base 30 is formed by two substantially parallel, laterally spaced arcuate rocker rails 32 and 34. Rocker rail 32 has an end cap 40 positioned at a front end 32*a*, and an end cap 42 positioned at a rear end 32*b*. Similarly, rocker rail 34 has a front end cap 44 positioned at end 34*a* and a rear end cap 46 positioned at rear end 34*b*.

The front support frame assembly includes a pair of substantially parallel arcuate tubes 50 and 52 that are pivotably connected at their respective front ends 50*a* and 52*a* to the respective front end caps 40 and 44. The pivotal connection 41 between front leg member 50 and front end cap 40 and the pivotal connection 45 between front leg member 52 and front end cap 44 allow the respective front legs to be pivoted between more upright and more reclined positions relative to the rocker rails 32 and 34. A transverse tube member 54 connected between the front leg members 50 and 52 maintains the front leg members in parallel relationship as well as providing a support for a rigid board 95 used in connection with the bottom seat portion 94 of seat 90.

The rear support frame assembly includes an adjustable, telescoping rear leg 60 that is connected to rear end cap 42 of rocker rail 32, and an adjustable, telescoping rear leg 64 is connected to rear end cap 46 of rocker rail 34. Rear leg 60 includes a lower leg portion 61 that is pivotably connected at end 61*a* by a pivotal connection 43 to the rear end cap 42. The upper end 61*b* of lower leg portion 61 is telescopically received within an upper leg portion 62. As best seen in FIG. 2, the relative positions between lower leg portion 61 and upper leg portion 62 can be maintained by a spring biased button 61*c* that engages with one of several desired openings through the upper leg portion 62. The spring biased button 61*c* can be of the type sold under the trademark VALCO.

Similarly, rear leg 64 includes a lower leg portion 65 and an upper portion 66 telescopically received over the lower leg portion. As seen in FIG. 1, the lower end 65*a* of lower leg portion 65 is pivotably connected by pivotal connection 47 to the rear end cap 46 of rocker rail 34. The upper end 65*b* of lower leg portion 65 is telescopically received within the upper leg portion 66 and maintained in position relative to the upper leg portion by a spring biased button 65*c* that engages with one of several desired openings through the upper leg portion 66, as seen in FIG. 2.

As seen in FIG. 1, the upper ends 62*b* and 66*b* of respective rear leg members 60 and 64 can be provided with a clevis-type joint for pivotal engagement with respective detachable joint members 70 and 72.

Figure 6A:
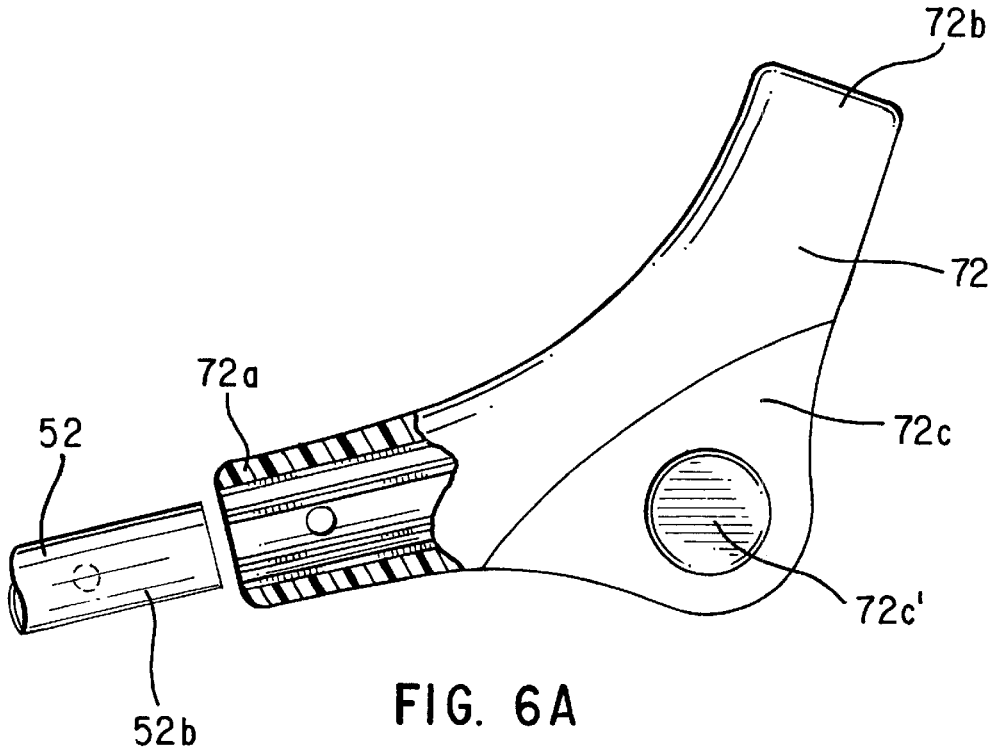
FIG. 6A is a detail side elevation view in partial cross section of the detachable joint provided between front and rear leg members.
Figure 6B:
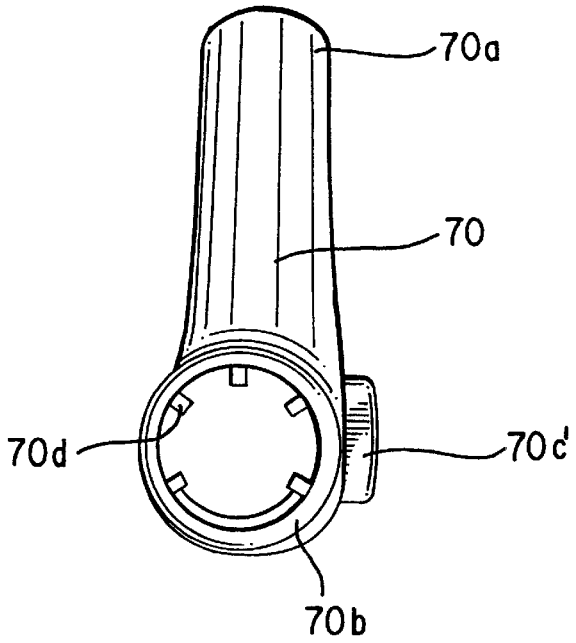
FIG. 6B is an end elevation view of the detail shown in FIG. 6A.

As best seen in FIGS. 1, 6A and 6B, detachable joint members 70, 72 are each provided with an opening at first end 70*a*, 72*a* for engagement with the end 50*b*, 52*b* of front leg members 50, 52 and an opening at opposite end 70*b*, 72*b* for receipt of one end 80*a*, 80*b* of a U-shaped seat back tube 80. At central portions 70*c*, 72*c* the detachable joint members 70, 72 are each provided with laterally-extending spring-biased buttons 70*c*', 72*c*' that engage with respective openings through the clevis ends 62*b*, 66*b* of respective leg members 60, 64. The openings at ends 70*b*, 72*b* of detachable joints 70, 72 can be provided with internal splines, such as internal splines 70*d* shown in FIG. 6B, that define the opening for ends 80*a*, 80*b* of seat back tube 80.

As seen in FIG. 1, transverse member 67 can also be provided extending between the upper leg portions 62 and 66 of respective rear leg members 60 and 64. A vibrating unit 68 can be mounted on the transverse member 67 in order to transmit a soothing vibration through the legs of the rocking chair and thus through the seat 90 to an infant positioned in the seat.

Figure 4:
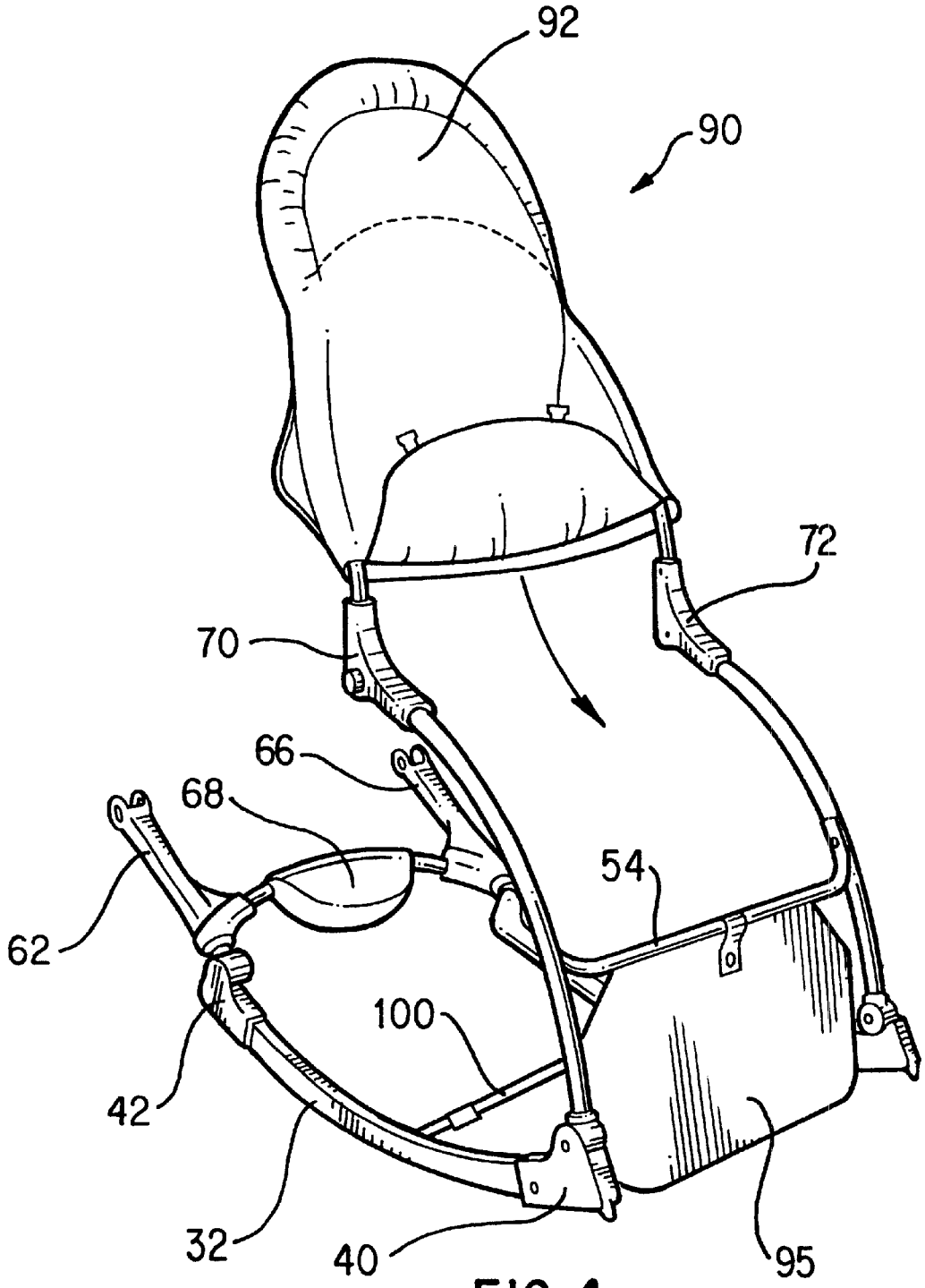
FIG. 4 is a perspective view of the rocker seat during assembly of the soft goods onto the seat back tube and front legs.

Seat 90 is formed by soft goods that are formed into a back support portion 92 and a bottom seat portion 94 and suspended over the seat back tube 80 and front assembly tubes 50 and 52. As best seen in FIG. 4, the soft goods are slid over seat back tube 80 and front assembly tubes 50 and 52 after they are assembled to detachable joints 70 and 72, but before the detachable joints 70 and 72 are connected to the rear leg members 60 and 64. The rigid seat board 95 can be inserted into a pocket at the bottom seat portion 94 of the soft goods forming the seat 90. A restraint pad 96 can also be provided between the bottom seat portion 94 and the back support portion 92 to constrain an infant seated in seat portion 90.

Figure 7:
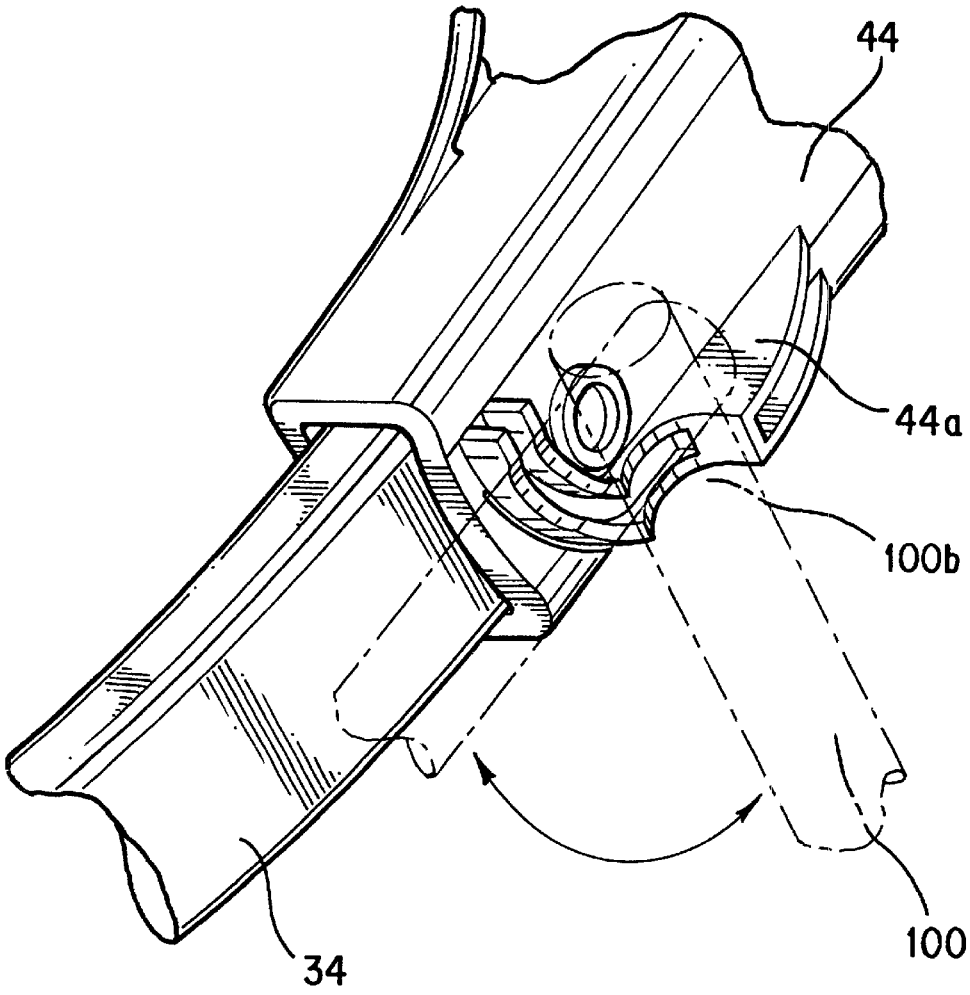
FIG. 7 is a detail view of the integral detent on an end cap at one end of a rocker rail in relationship to extended and retracted positions of a kickstand.

As best seen in FIGS. 1 and 7, a transverse propping member or kickstand 100 is pivotably connected at one end 100*a* to the front end cap 40 on rocker rail 32 and pivotably connected at the other end 100*b* to the front end cap 44 on rocker rail 34. Each of the front end caps 40 and 44 can also be provided with integrally molded detents 40*a* (not shown) and 44*a* on their inside facing surfaces to receive the kickstand 100 in its retracted position substantially flush with the rocker rails 32, 34, and in its extended position when it is desired to maintain the rocker seat in a stationary position.

Figure 5:
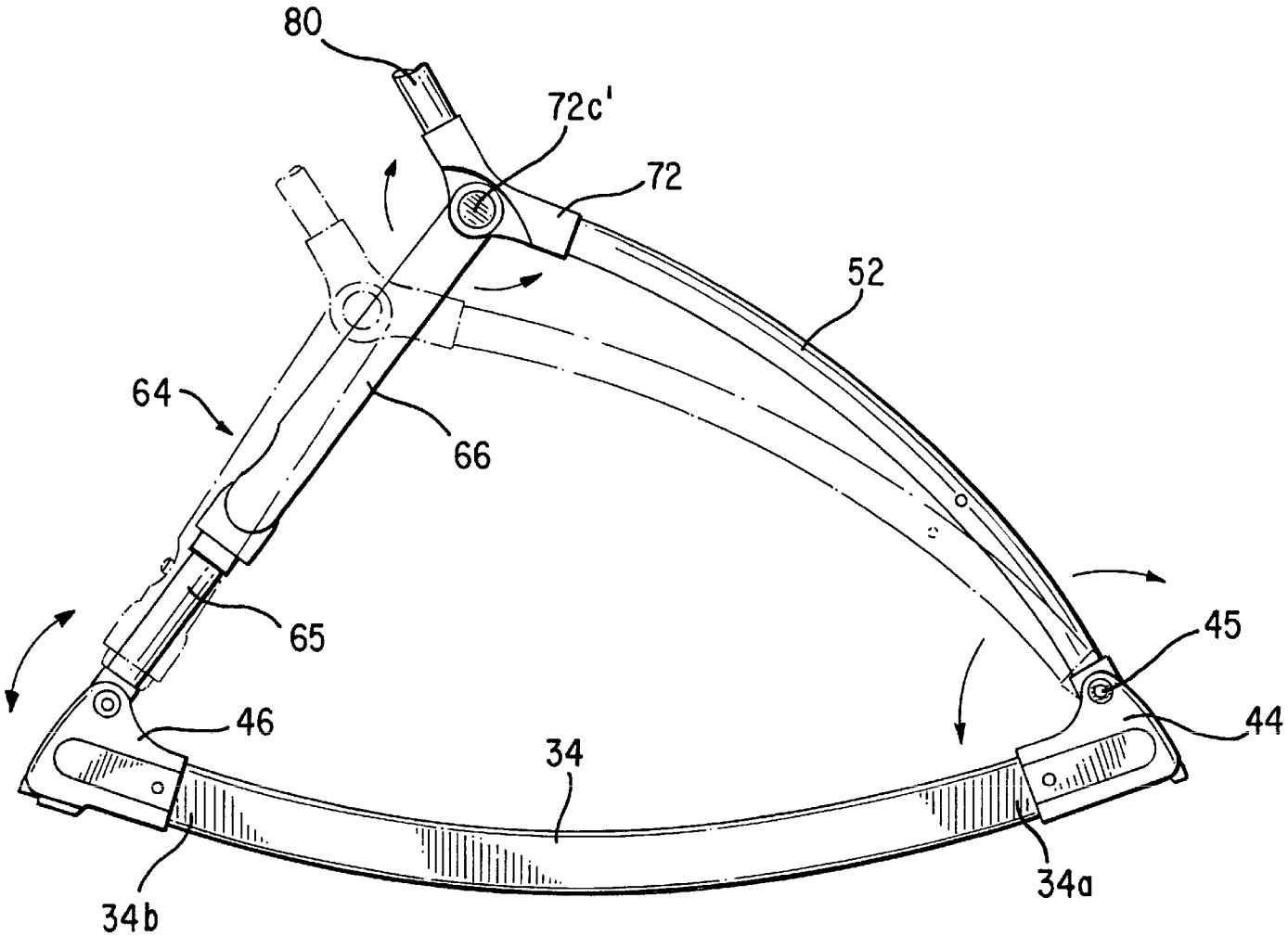
FIG. 5 is a schematic view illustrating the pivoting movement of front and rear legs and telescoping of the rear leg relative to the rocker rail.

With the above construction and arrangement of the parts of the multi-purpose adjustable rocker seat in accordance with the invention, the seat can be employed in the following several ways:

As seen in FIG. 2, when it is desired to place the rocker seat in a more reclined position suitable for supporting a small infant, the spring biased buttons 61*c* and 65*c* extending through the openings in upper rear leg portions 62 and 66 can be depressed in order to allow the upper rear leg portions to be telescoped down over the lower rear leg portions 61 and 65. Referring to FIG. 5 for a representative illustration of the telescoping and pivoting motion of the front and rear legs relative to a rocker rail, as upper rear leg portions 62 and 66 are moved downwardly over the lower rear leg portions the resulting downward movement of detachable joints 70 and 72 causes front leg portions 50 and 52 to pivot about their front pivot connections 41 and 45 relative to rocker rails 32 and 34. The pivotal movement of the rear leg members and front leg members relative to the rocker base also causes a change in orientation of the detachable joints 70 and 72 relative to rocker rails 32 and 34 such that seat back tube 80 is moved to a more reclined position relative to the rocker base. The front kickstand 100 can be rotated to its extended position as shown in FIGS. 1 and 3 if it desired to maintain the rocker chair 20 in a stationary position.

Figure 3:
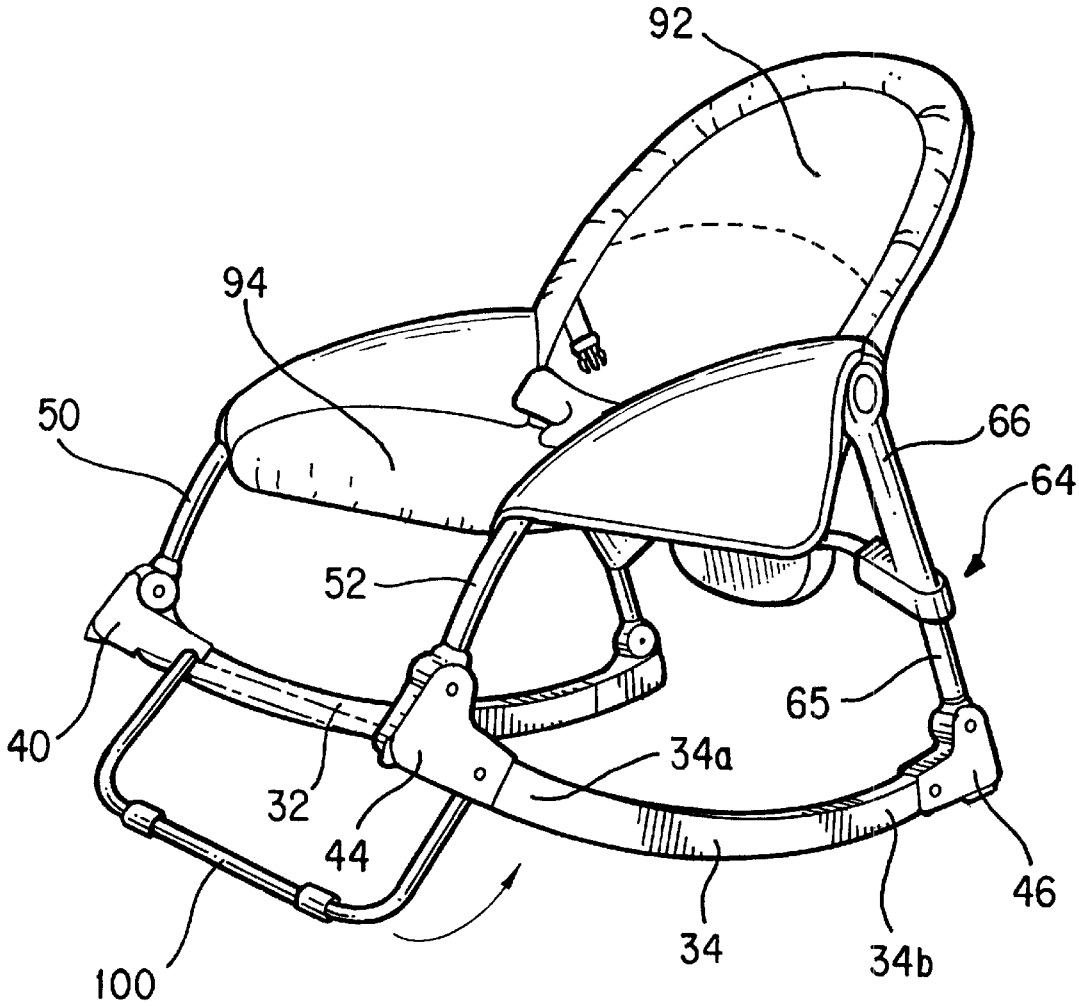
FIG. 3 is a front perspective view of the rocker seat shown in FIG. 1, illustrating the kickstand in a position to preventing rocking of the seat.

If it is desired to use the chair in a more upright, stationary position such as shown in FIG. 3 during feeding of the infant or for other uses, the spring biased buttons 61*c* and 65*c* (best seen in FIG. 2) can be depressed within the openings through upper rear leg portions 62 and 66 and the upper rear leg portions can be telescoped relative to lower rear leg portions 61 and 65 to increase the length of the rear leg members 60 and 64. Again the interconnection between the rear leg members, the front leg members and the seat back tube through the detachable joints 70 and 72 results in the front and rear leg members pivoting relative to the rocker base as the rear leg members are telescoped to a longer, more extended position.

As an infant grows in size to a toddler, the rocker seat can be easily adjusted as described above by increasing the length of rear leg members 60 and 64 to convert the rocker seat to a more upright rocking chair type configuration.

The above described changes in configuration of the rocking chair achieved by a simple adjustment in the lengths of the rear leg members without the use of any tools, allow the rocking chair to be readily adapted as an infant grows in size to a toddler. The rocking chair can also be readily folded into a relatively flat configuration when not in use by simply depressing the spring loaded buttons 70*c*' and 72*c*' (seen in FIG. 5) of detachable joints 70 and 72 and disengaging them from the clevis ends 62*b* and 66*b* of the rear leg members 60 and 64. With the detachable joints 70 and 72 being disengaged from rear leg members 60 and 64 but still connected to front leg members 50 and 52 and to the seat back tube 80, the rear leg members can be folded down toward the rocker rails 32 and 34, and the front leg members 50, 52, joints 70, 72, and seat back tube 80 can be folded down toward the rocker rails 32 and 34, thus readily folding the entire rocking chair into a relatively flat configuration.

It will be understood that various modifications and changes can be made in the configuration of the disclosed adjustable rocker seat without departing from the scope or intent of the appended claims. As an example, the number of openings through the upper rear leg members 62 and 66 can be increased in order to allow for a multiple of different height positions to which the chair can be adjusted. Additionally, the interconnection between the rear leg members 60 and 64 and the detachable joints 70 and 72 could be provided with the spring loaded buttons mounted on the rear leg members rather than on the detachable joints, and openings provided in the detachable joints rather than through the clevis ends of the rear leg members. Additionally, the front support assembly could be made axially adjustable rather than the rear support assembly with some simple modifications to the soft goods supported on the frame assembly. The axial length adjustments in the front or rear support assemblies can be provided by any suitable structure including, but not limited to, telescoping tubes, or tubes offset from each other with some kind of sliding connector between them. Furthermore, the support frame assemblies are not necessarily limited to pairs of substantially parallel tubes, and the rocker base is not limited to a pair of discrete rocker rails. The support frame assemblies could be formed from any of a variety of alternative structures including X-frames, or even solid frames, and the rocker base could be provided as a solid base with an arcuate bottom.

What is claimed is:

1. A rocking chair, comprising:

a rocking base;

a seat; and a collapsible, adjustable support frame coupled to said base and said seat to support said seat relative to said base in a first inclined position and a second reclined position, said support frame having a front frame portion and a rear frame portion, one of said frame portions being adjustable in length and both of said frame portions being pivotably coupled to said base;

wherein said rear frame portion is adjustable in length and is attached to a rear portion of said base;

wherein said front frame portion is pivotably attached to said rear frame portion at respective upper ends of said frame portions; and wherein said rear frame portion is releasably coupled at an upper end thereof to said seat by a detachable joint.

2. A rocking chair, comprising:

a rocking base;

a seat; and a collapsible, adjustable support frame coupled to said base and said seat to support said seat relative to said base in a first inclined position and a second reclined position, said support frame having a front frame portion and a rear frame portion, one of said frame portions being adjustable in length and both of said frame portions being pivotably coupled to said base;

wherein said rear frame portion is adjustable in length and is attached to a rear portion of said base; and wherein said rear frame portion includes first and second laterally spaced telescoping tubes.

3. An adjustable chair, comprising:

a seating portion;

a rocking base;

a pair of front legs and a pair of rear legs extending between said rocking base and said seating portion, with each of said front legs being pivotably connected to a respective one of said rear legs and with each of said front legs and said rear legs being pivotably connected to said rocking base;

wherein said rear legs are adjustable in length;

wherein said seating portion includes a back support portion and a bottom, with said back support portion being connected to said rear legs; and wherein a detachable joint provides the pivotable connection between each of said front legs and the respective one of said rear legs and the connection between said back support portion and said rear legs.

4. The adjustable chair according to claim 3, further including a kickstand pivotably attached at an upper end thereof to said rocking base for adjustment between a first position wherein the adjustable chair can rock on said rocking base and a second position wherein a lower end of said kickstand projects downwardly from said base to engage a support surface, thereby preventing the chair from rocking on said rocking base.

5. The adjustable chair according to claim 4 wherein said back support portion includes a U-shaped member, each end of which is received within an opening in one of said detachable joints.

6. The adjustable chair according to claim 5, wherein the pivotable connection between each of said front legs and a respective rear leg is made by engagement of a spring-biased protrusion on one of the respective detachable joint and the respective rear leg and an opening in the other of the respective detachable joint and the respective rear leg.

7. A children's chair, comprising:

a seat portion;

a rocking base;

a support structure extending between said rocking base and said seat portion and being pivotably connected to said rocking base at front and rear portions of said rocking base, with the portion of said support structure pivotably connected to the rear portion of the rocking base being adjustable in length;

wherein said seat portion is moved between a more reclined position and a more inclined position by adjustments in the length of the portion of said support structure pivotably connected to the rear portion of the rocking base;

wherein said support structure includes a pair of front legs pivotably connected to said rocking base and a pair of rear legs pivotably connected to said rocking base;

wherein each of said front legs is pivotably connected to a respective one of said rear legs; and wherein the pivotable connection between each of said front legs and the respective rear leg is formed by a detachable joint, and the detachable joints further provide connections between said legs and a back support portion of said seat portion.

8. The children's chair according to claim 7, further including a propping member for preventing rocking of the chair on said rocking base.

9. The children's chair according to claim 8, wherein said propping member is pivotably connected to said rocking base and said rocking base includes a detent for maintaining said propping member in either of an extended or a retracted position to restrain or permit rocking motion of the chair, respectively.

10. A child support configurable between upright, reclined and folded positions, said child support being supportable upon a support surface, and comprising:

a seat portion including a frame;

a rocker base adapted for permitting said child support to be used as a child's rocker chair;

a first leg extending forwardly and downwardly from said frame, said first leg having a lower end hinged to said rocker base and an upper end coupled to said frame;

a second leg pivotally coupled to, and extending downwardly from said frame;

a frame connector coupled to said frame;

said first leg is coupled to said frame through said frame connector; and said second leg is pivotally coupled to said frame connector at an upper end thereof;

wherein when said child support is configured in its upright position, said first leg is attached to said rocker base and extends forwardly and downwardly at a first angle relative to the support surface so as to form a support suitable as a toddler seat;

wherein when said child support is configured in its reclined position, said first leg is attached to said rocker base and extends forwardly and downwardly at a second angle relative to the support surface so as to form a support suitable as an infant seat, said second angle being less than said first angle;

wherein when said child support is configured in its folded position, said first leg extends at a third angle relative to the support surface, said third angle being less than said second angle;

wherein said frame connector comprises a joint member; and wherein said joint member includes a slot for receiving an upper end of said first leg.

11. A child support configurable between upright, reclined and folded positions, said child support being supportable upon a support surface, and comprising:

a seat portion including a frame;

a rocker base adapted for permitting said child support to be used as a child's rocker chair;

a first leg extending forwardly and downwardly from said frame, said first leg having a lower end hinged to said rocker base and an upper end coupled to said frame;

a second leg pivotally coupled to, and extending downwardly from said frame;

a frame connector coupled to said frame;

said first leg is coupled to said frame through said frame connector; and said second leg is pivotally coupled to said frame connector at an upper end thereof;

wherein when said child support is configured in its upright position, said first leg is attached to said rocker base and extends forwardly and downwardly at a first angle relative to the support surface so as to form a support suitable as a toddler seat;

wherein when said child support is configured in its reclined position, said first leg is attached to said rocker base and extends forwardly and downwardly at a second angle relative to the support surface so as to form a support suitable as an infant seat, said second angle being less than said first angle;

wherein when said child support is configured in its folded position, said first leg extends at a third angle relative to the support surface, said third angle being less than said second angle; and wherein said frame connector includes a latch portion for configuring said child support from one of its upright and reclined positions to its folded position.

12. The child support of claim 11, wherein said latch portion detaches said second leg from said frame connector.

13. A method of adjusting the inclination of a seat supported relative to a rocker base by a support frame having a front support frame portion coupling a front portion of the seat to a front portion of the base and a length adjustable rear support frame portion coupling a rear portion of the seat to a rear portion of the base, comprising the steps of:

shortening the length of the rear support frame portion to bring the rear portion of the seat closer to the rear portion of the base;

pivoting the front frame portion with respect to the base; and further including the step of folding the seat into a stowed configuration by detaching an upper end of said front support frame portion from an upper end of said rear support frame portion and pivoting both of said front and rear frame portions about lower ends of said front and rear frame portions relative to said base.

* * * * *